US009250565B2

(12) United States Patent
Yasui

(10) Patent No.: US 9,250,565 B2
(45) Date of Patent: Feb. 2, 2016

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventor: Kojiro Yasui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/546,716

(22) Filed: Nov. 18, 2014

(65) Prior Publication Data

US 2015/0139683 A1 May 21, 2015

(30) Foreign Application Priority Data

Nov. 20, 2013 (JP) ..... 2013-240143

(51) Int. Cl.
*G03G 15/08* (2006.01)

(52) U.S. Cl.
CPC ..... *G03G 15/0817* (2013.01); *G03G 15/0812* (2013.01)

(58) Field of Classification Search
CPC ..... G03G 15/0813; G03G 15/0817
See application file for complete search history.

(56) References Cited

U.S. PATENT DOCUMENTS

2014/0314444 A1* 10/2014 Ogino ..... 399/111

FOREIGN PATENT DOCUMENTS

JP 3403094 B2 5/2003
JP 2003-255702 A 9/2003

* cited by examiner

*Primary Examiner* — Gregory H Curran
(74) *Attorney, Agent, or Firm* — Canon USA Inc. IP Division

(57) ABSTRACT

A developing device includes a developer bearing member, a developer regulating member, and a space ensuring member. The space ensuring member includes a maintaining unit configured to maintain the space between the image bearing member and the developer bearing member, a rotation regulating portion configured to prevent the space ensuring member from moving, and a cover portion disposed to be not in contact with a surface of the developer bearing member and configured to cover a part of the developer bearing member. The cover portion is configured to cover at least part of an area in which the developer bearing member faces the image bearing member in a rotational direction of the developer bearing member, the area being on an outer side than an end portion of the developer regulating member in a longitudinal direction of the developer bearing member.

20 Claims, 10 Drawing Sheets

DEVELOPING DEVICE, PROCESS CARTRIDGE, AND IMAGE FORMING APPARATUS

BACKGROUND OF THE INVENTION

1. Field of the Invention

The present invention relates to a developing device that develops a latent image formed on an image bearing member, a process cartridge that attaches to and detaches from an apparatus main body of an image forming apparatus, and an image forming apparatus that forms an image on a recording medium.

The image forming apparatus includes an electrophotographic copying machine and an electrophotographic printer (for example, a laser beam printer, a light emitting diode (LED) printer, and the like), a facsimile machine, a word processor, and the like that employ an electrophotographic image forming process.

2. Description of the Related Art

Conventionally, a developing device is used for developing a latent image, formed on a photosensitive drum by a developer, in an image forming apparatus employing an electrophotographic image forming process.

In such a developing device, a developing blade is disposed on a developing roller as a developer bearing member. Furthermore, a seal member is disposed on an end portion of the developing roller in a longitudinal direction. The developing blade serves as a developer regulating member that regulates a thickness of a layer of the developer. The seal member prevents the developer from leaking in the longitudinal direction.

In the developing device, a gap between the developing blade and the seal member in the longitudinal direction might include an area where the thickness of the layer is not regulated by the developing blade. Thus, the developer in this area might be accidentally transferred onto the photosensitive drum. When this happens, an image defect (end portion fogging), in the form of a black streak, might occur in an end portion of a paper sheet (recording medium) in a direction orthogonal to a feed direction. The fogging basically means that the developer is attached to an unintended portion. The end portion fogging is the fogging occurring in the end portion of the recording medium.

A technique for preventing the end portion fogging have been discussed in Japanese Patent Application Laid-Open No. 2003-255702 and Japanese Patent No. 3403094. Specifically, for example, the developer not passing through the developing blade is scraped by a scraper and is prevented from being developed on a drum.

SUMMARY OF THE INVENTION

In view of the problem described above, the present invention is directed to providing a developing device, a process cartridge, and an image forming apparatus that are capable of preventing fogging from occurring outside a developer regulating member.

According to an aspect of the present invention, a developing device includes a developer bearing member configured to carry a developer for developing a latent image formed on an image bearing member, a developer regulating member configured to regulate an amount of the developer carried by the developer bearing member, and a space ensuring member configured to define a space between the image bearing member and the developer bearing member. The space ensuring member includes a maintaining unit configured to maintain the space between the image bearing member and the developer bearing member by being in contact with the image bearing member, a rotation regulating portion configured to prevent the space ensuring member from moving in a rotational direction of the developer bearing member, and a cover portion disposed to be not in contact with a surface of the developer bearing member and configured to cover a part of the developer bearing member. The cover portion is configured to cover at least part of an area in which the developer bearing member faces the image bearing member in the rotational direction of the developer bearing member, the area being on an outer side than an end portion of the developer regulating member in a longitudinal direction of the developer bearing member.

Other aspects of the present invention include a process cartridge and an image forming apparatus including the developing device.

Further features of the present invention will become apparent from the following description of exemplary embodiments with reference to the attached drawings.

DESCRIPTION OF THE EMBODIMENTS

A first exemplary embodiment of the present invention will be exemplarily described in detail with reference to the drawings. It is to be noted that the scope of the present invention is not limited to the size, material, shape, and relative arrangement of components described in this exemplary embodiment, unless otherwise noted. The material, shape, and the like of components once described in the following description are the same throughout the remaining part of the description, unless particularly redefined.

In the description below, a "longitudinal direction" is an axial direction of a developing roller 10*d* (a direction parallel to the axis of the developing roller 10*d*) unless otherwise noted.

(Description on Entire Electrophotographic Image Forming Apparatus)

Figure 2:
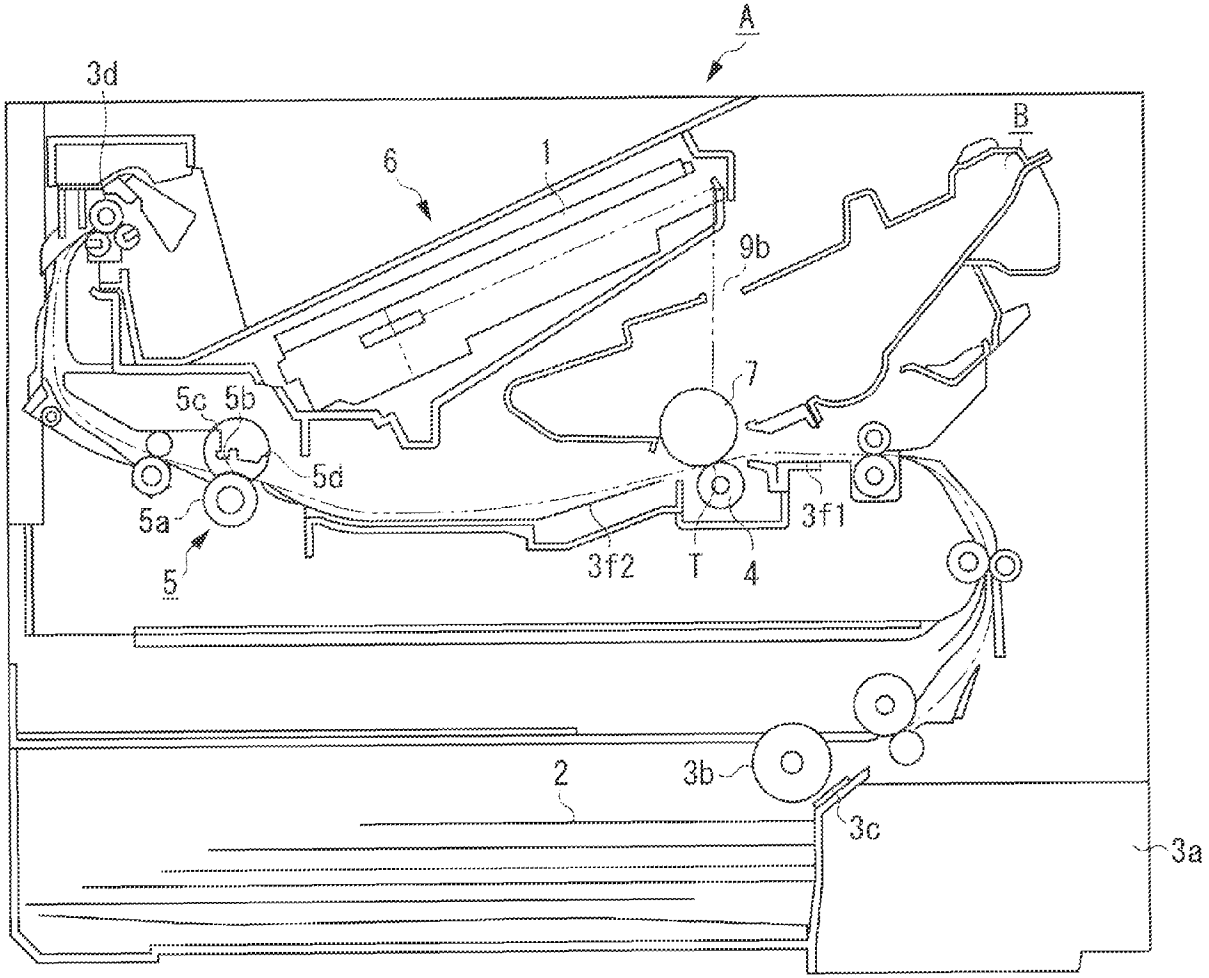
FIG. 2 is a cross-sectional view illustrating a configuration of an image forming apparatus according to an exemplary embodiment.

First of all, the configuration of an entire electrophotographic image forming apparatus (hereinafter, referred to as "image forming apparatus") will be schematically described with reference to FIG. 2. FIG. 2 is a schematic cross-sectional view of an image forming apparatus, according to the present exemplary embodiment, having a process cartridge B installed. More specifically, FIG. 2 is a schematic cross-sectional view of a laser beam printer as one type the image forming apparatus. The process cartridge B is detachably attached to an apparatus main body of the image forming apparatus, and includes a photosensitive drum 7 (image bearing member) and a process unit that performs processing on the photosensitive drum 7. The apparatus main body is a configuration of the image forming apparatus without the process cartridge B.

As shown in FIG. 2, the image forming apparatus (laser beam printer) A according to the present exemplary embodiment irradiates the photosensitive drum 7 having a drum shape with information light, based on image information, from an optical system 1 as an optical unit. Thus, a latent image (electrostatic latent image) is formed on the photosensitive drum 7. The electrostatic latent image is developed by a developer (toner), whereby a toner image is formed. Separation feeding of a recording medium 2 is performed one sheet at a time from a cassette 3*a* by a pickup roller 3*b* and a pressing member 3*c*. The pressing member 3*c* comes into pressure contact with the pickup roller 3*b*. The separation feeding and the toner image forming are performed in synchronization. The recording medium 2 having a surface on which an image is to be formed, is usually a recording sheet. Alternatively, a medium other than a paper sheet such as an overhead projector (OHP) sheet and a fabric may be used, depending on the configuration of the image forming apparatus A.

The recording medium 2 thus fed is conveyed along a conveyance guide 3*f*1 to a transfer unit T. In the transfer unit T, the photosensitive drum 7 and a transfer roller 4 as a transfer unit face each other.

In the transfer unit T, the transfer roller 4 to which a voltage is applied transfers the toner image formed on the photosensitive drum 7 onto the conveyed recording medium 2. Then, the resultant recording medium 2 is conveyed to a fixing unit 5 along a conveyance guide 3*f*2.

The fixing unit 5 includes a driving roller 5*a* and a fixing rotating member 5*d*. The fixing rotating member 5*d* is equipped with a heater 5*b* and is formed of a cylindrical sheet rotatably supported by a supporting member 5*c*. The fixing unit 5 applies heat and pressure to the recording medium 2 passing through the fixing unit 5, so that the transferred toner image is fixed.

A discharge roller 3*d* conveys the recording medium 2 with the toner image thus fixed, so that the recording medium 2 is discharged onto a discharge unit 6 through a reversing conveyance path. In the present exemplary embodiment, a pickup roller 3*b*, a pressing member 3*c*, the discharge roller 3*d*, and the like form a conveyance unit (conveyance mechanism). The conveyance unit is a unit (mechanism) that conveys the recording medium 2.

(Process Cartridge)

Figure 3:
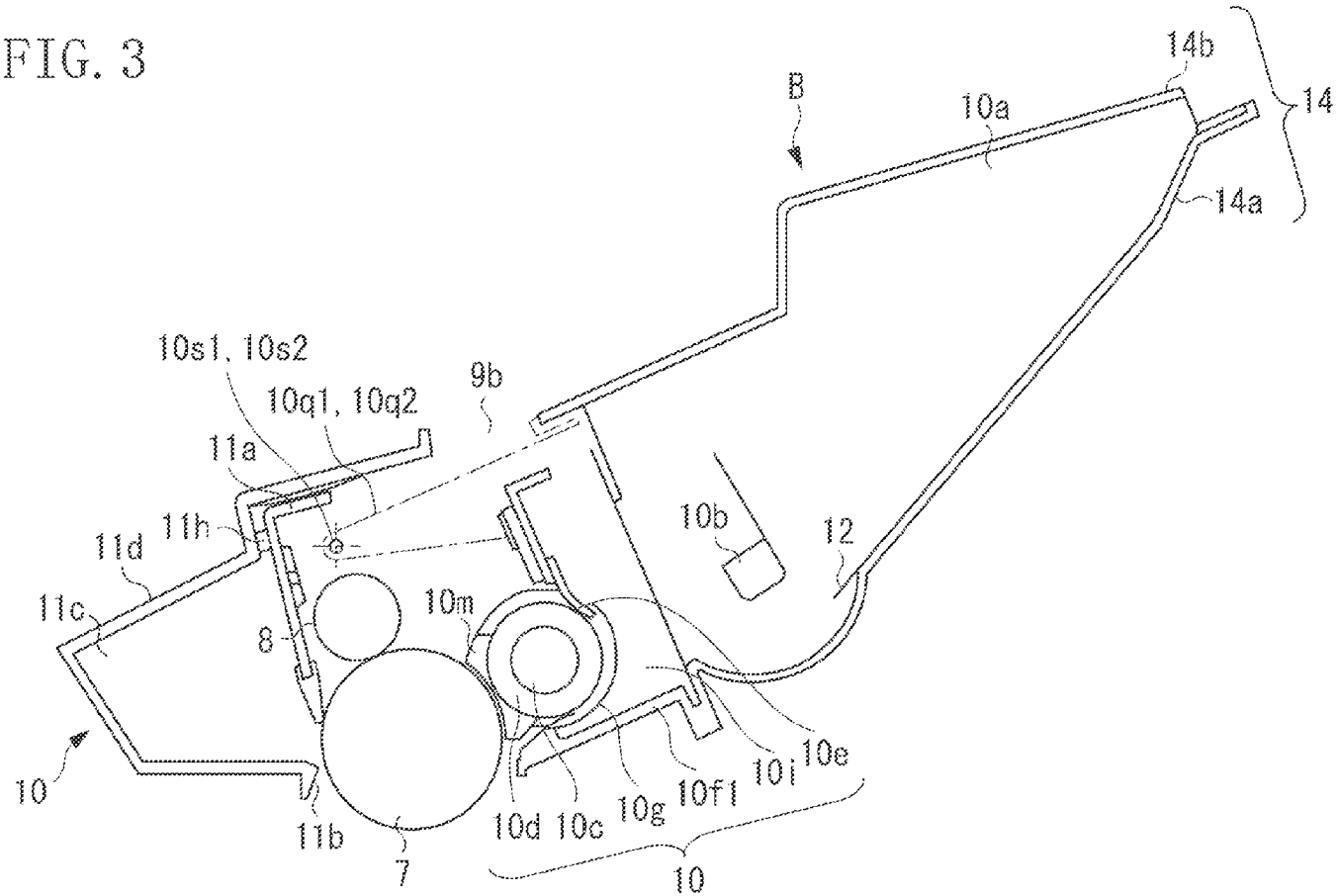
FIG. 3 is a cross-sectional view of a process cartridge according to an exemplary embodiment.

A configuration of the entire process cartridge B will be schematically described with reference to FIGS. 2, 3, and 6. FIG. 3 is a schematic cross-sectional view illustrating the process cartridge B according to the present exemplary embodiment.

As illustrated in FIG. 3, the process cartridge B includes at least the photosensitive drum 7 (image bearing member) and at least one process unit that performs processing on the photosensitive drum 7. A process included in the process cartridge B includes, for example, a charging unit (charging member) that charges the photosensitive drum 7, a cleaning unit (cleaning member) that cleans the remaining toner on the photosensitive drum 7, and the like.

The process cartridge B according to the present exemplary embodiment includes a drum unit 11 including the photosensitive drum 7 and a developing unit 10 including the developing roller 10*d* (developer bearing member). The drum unit 11 includes a cleaning blade 11*a* as a cleaning unit (cleaning member), a charging roller 8 as a charging unit (charging member), and a drum frame member 11*d* incorporating the components. The developing unit 10 includes a developing frame member 10*f*1 that rotatably supports the developing roller 10*d* and a toner frame member 14 forming a toner chamber 10*a* containing the toner as the developer. The developing frame member 10*f*1 and the toner frame member 14 are coupled to each other to form a frame member of the developing unit 10.

The process cartridge B according to the present exemplary embodiment rotates the photosensitive drum 7 including a photosensitive layer and applies a voltage to the charging roller 8 as the charging unit. Thus, the surface of the photosensitive drum 7 is uniformly charged. The charged photosensitive drum 7 is exposed to the information light (light image), based on the image information, from the optical system 1 through an exposure opening 9*b*, as illustrated in FIG. 2. Thus, an electrostatic latent image is formed on the surface of the photosensitive drum 7. The electrostatic latent image is developed by the developing unit 10.

In the developing unit 10, a rotatable developer conveying member (hereinafter, referred to as "toner feeding member") 10*b* and an elastic sheet 12 feed the toner in the toner chamber 10*a* as a toner containing unit, into a developing chamber 10*i*. The elastic sheet 12 comes into contact with the rotating toner feeding member 10*b* and vibrates.

The developing roller 10*d*, equipped with a fixed magnet 10*c*, is rotated and, at the same time, a layer of toner charged by friction by a developing blade 10*e* as a developer regulating member is formed on the surface of the developing roller 10*d*. The toner is transferred onto the photosensitive drum 7 in accordance with the electrostatic latent image so that a toner image (developer image) is formed, whereby a visible image is obtained.

A voltage of a polarity opposite to that of the toner image is applied to the transfer roller 4, whereby the toner image is transferred onto the recording medium 2. Then, the remaining toner on the photosensitive drum 7 is scraped off by the cleaning blade 11*a*, and then picked up by a scoop sheet 11*b* to be collected into a removed toner container 11*c*.

As described above, the developing roller 10*d* is a developer bearing member that carries the developer (toner) for developing the latent image formed on the photosensitive drum 7. The photosensitive drum 7 is an image bearing member on which the latent image is formed and developed. Thus, the photosensitive drum 7 carries the toner image (developer image).

Figure 7:
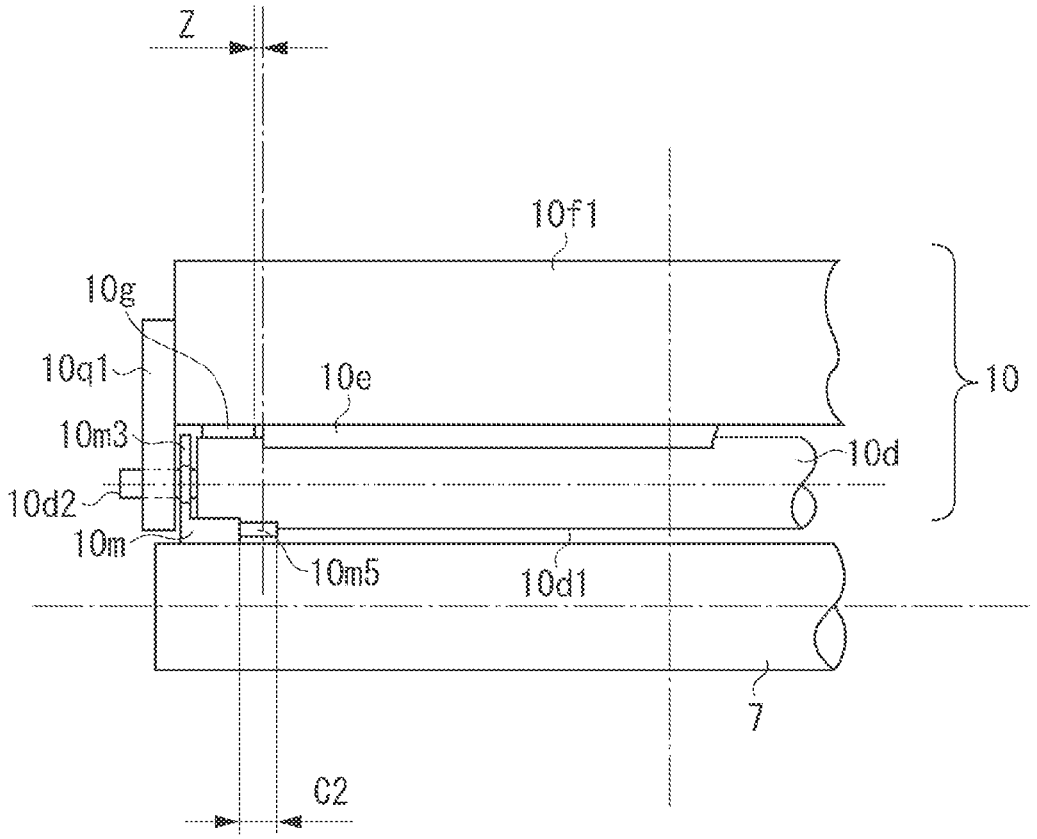
FIG. 7 is an explanatory diagram illustrating a configuration in a longitudinal direction according to an exemplary embodiment.

The developing blade 10*e* is arranged in the longitudinal direction with a gap Z from a seal member 10*g* provided as illustrated in FIG. 7.

Figure 6:
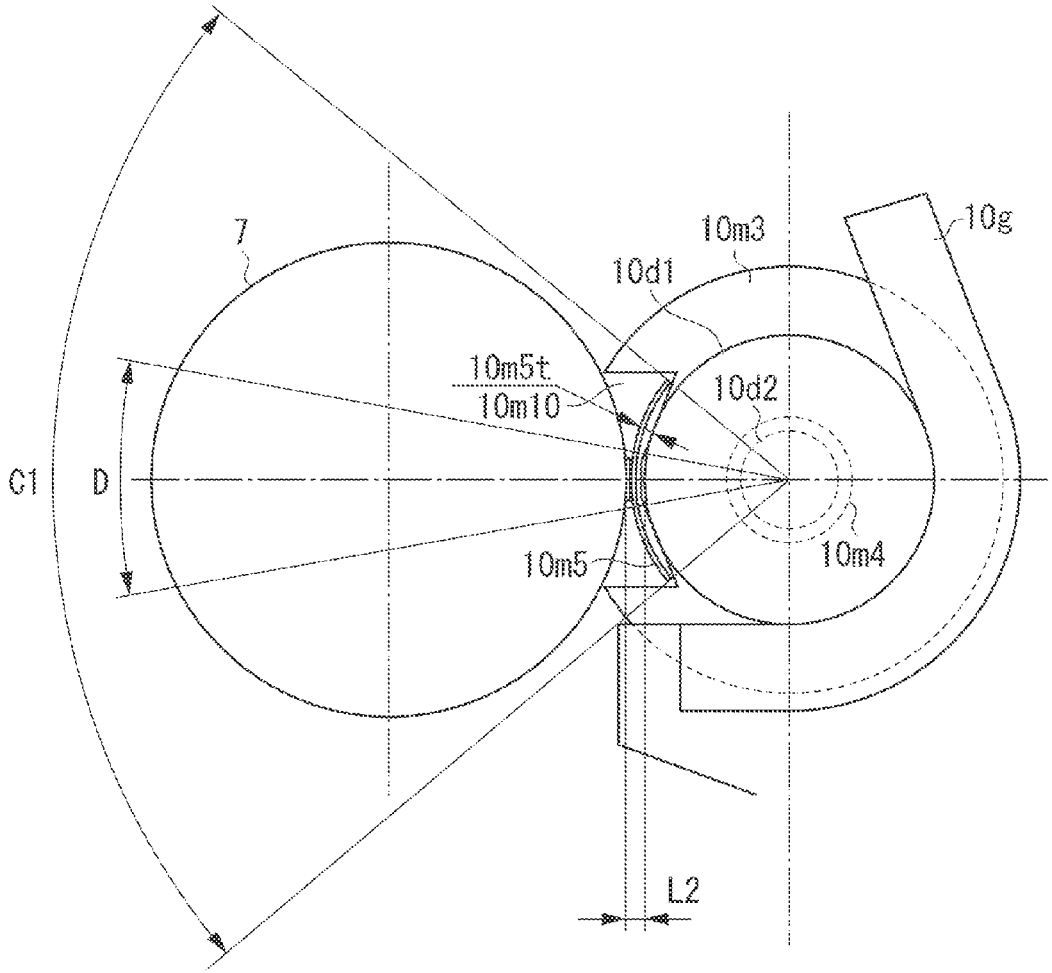
FIG. 6 is a cross-sectional view of the space ensuring member according to an exemplary embodiment.

As illustrated in FIGS. 3, 6, and 7, in each of both end portions of the developing roller 10*d*, the seal member 10*g* is attached to the developing frame member 10*f*1. The seal member 10*g* is provided for preventing the toner from leaking through a gap between the end portion of the developing roller 10*d* and the developing frame member 10*f*1. Thus, the seal member 10*g* prevents the toner from leaking outside of the frame member (the developing frame member 10*f*1 and the toner frame member 14) of the developing unit 10.

The seal member 10*g* includes a non-woven fabric and a pile formed of fibers, such as Teflon (registered trademark) and nylon. The toner is held with the seal member 10*g* which is in contact with the developing roller 10*d*.

The configuration of the seal member 10*g* is not limited to that described above. The seal member 10*g* may be a magnetic member (for example, iron) exerting magnetic force. Thus, the toner may be held by a magnetic field formed between the seal member 10*g* and the fixed magnet 10*c* equipped with the developing roller 10*d* whereby the toner is prevented from leaking. In this configuration, the toner is held by the seal member 10*g* and the developing roller 10*d* in a noncontact state.

The seal member 10*g* is arranged in the longitudinal direction. Specifically, the seal member 10*g* is disposed in the end portion of the developing roller 10*d* in the longitudinal direction.

As illustrated in FIG. 3, the developing frame member 10*f*1 includes arm units 10*q*1 and 10*q*2. Coupling holes 10*s*1 and 10*s*2 are respectively formed in the arm units 10*q*1 and 10*q*2. The drum unit 11 and the developing frame member 10*f*1 are coupled with each other when a pin is inserted through the coupling holes 10*s*1 and 10*s*2. Thus, the developing unit 10 including the developing roller 10*d* is rotatably supported by the drum unit 11 including the cleaning blade 11*a*.

With this configuration, the developing unit 10 is relatively movable to the drum unit 11. A spring (not illustrated) is provided between the developing unit 10 and the drum unit 11. Thus, predetermined force f is applied between the developing unit 10 and the drum unit 11, so that the developing roller 10*d* is urged toward the photosensitive drum 7. As described above, the force of the spring is used as the force f for urging the developing roller 10*d* toward the photosensitive drum 7. Alternatively, the developing roller 10*d* may be urged toward the photosensitive drum 7 by its own weight or the weight of the developing unit 10. Thus, the process cartridge B is not limited to the configuration in which the spring is provided.

A spacer 10*m* (space ensuring member) is disposed in each of both end portions of the developing roller 10*d* in the longitudinal direction. The spacer 10*m* defines a space between the developing roller 10*d* and the photosensitive drum 7. As described below, the spacer 10*m* maintains a constant space between the respective surfaces of the developing roller 10*d* and the photosensitive drum 7.

The toner carried by the developing roller 10*d* jumps from the developing roller 10*d* to the photosensitive drum 7 by an effect of an electric field formed between the developing roller 10*d* and the photosensitive drum 7. Thus, the image forming apparatus A of the present exemplary embodiment employs a noncontact developing system (jumping contact system).

(Space Ensuring Member that Ensures a Space Between Developing Roller and Photosensitive Drum)

The configuration of the spacer 10*m* (space ensuring member) is described in detail with reference to FIGS. 1, 4, 6, and 7.

As illustrated in FIGS. 6 and 7, the developing roller 10*d* includes a large diameter portion 10*d*1 and a small diameter portion 10*d*2. The small diameter portion 10*d*2 is disposed on an outer side of the large diameter portion 10*d*1 in the longitudinal direction, and is smaller than the large diameter portion 10*d*1. The large diameter portion 10*d*1 and the small diameter portion 10*d*2 are substantially coaxially arranged. The large diameter portion 10*d*1 is a portion (bearing portion) that carries the toner on its surface. For example, the large diameter portion 10*d*1 may be formed of an aluminum roller (aluminum sleeve) having a cylindrical shape. In the present exemplary embodiment, the spacer 10*m* comes into contact with the large diameter portion 10*d*1 to thereby maintain the space between the developing roller 10*d* and the photosensitive drum 7 (described in detail later). The small diameter portion 10*d*2 is a shaft portion (shaft) of the developing roller 10*d* and is supported by the developing frame member 10*f*1. Specifically, a bearing included in the developing frame member 10*f*1 rotatably supports the small diameter portion 10*d*2, whereby the developing roller 10*d* is rotatably arranged.

The spacer 10*m* is formed by injection molding with polyacetal as a material. Other resins such as polyethersulfone, polyphenylene sulfide, or nylon may be appropriately selected as the material of the spacer 10*m*.

Figure 1:
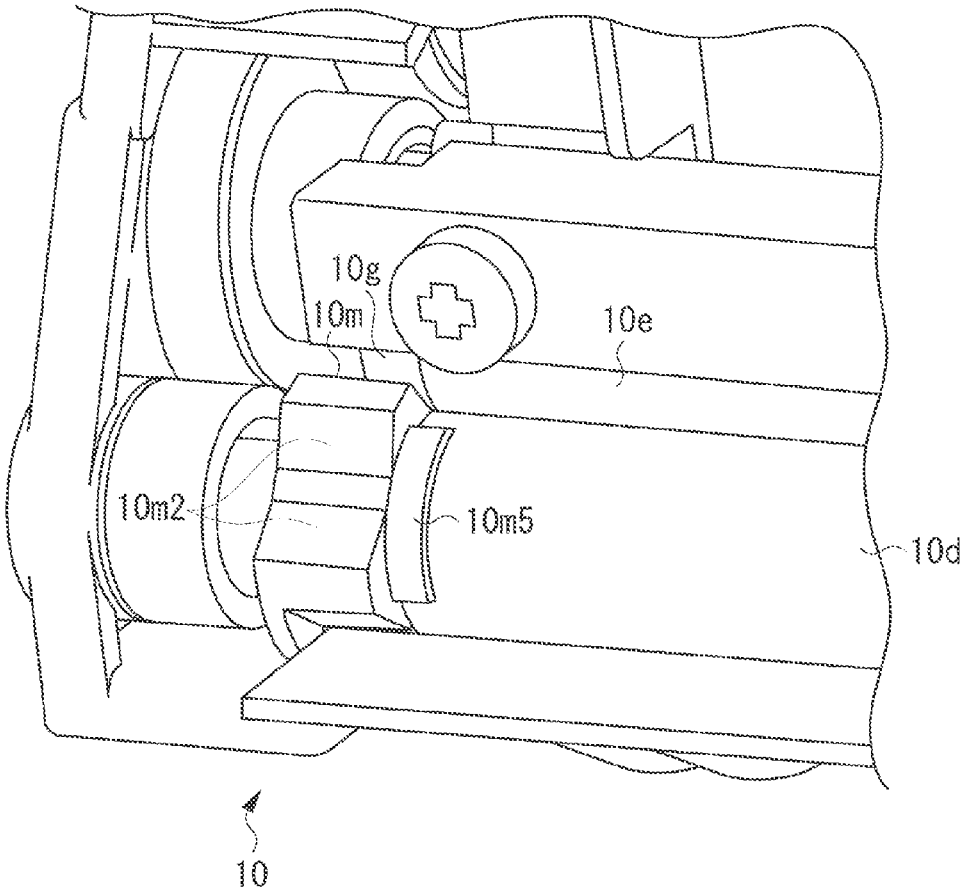
FIG. 1 is an explanatory diagram illustrating a configuration of a space ensuring member according to an exemplary embodiment.
Figure 4:
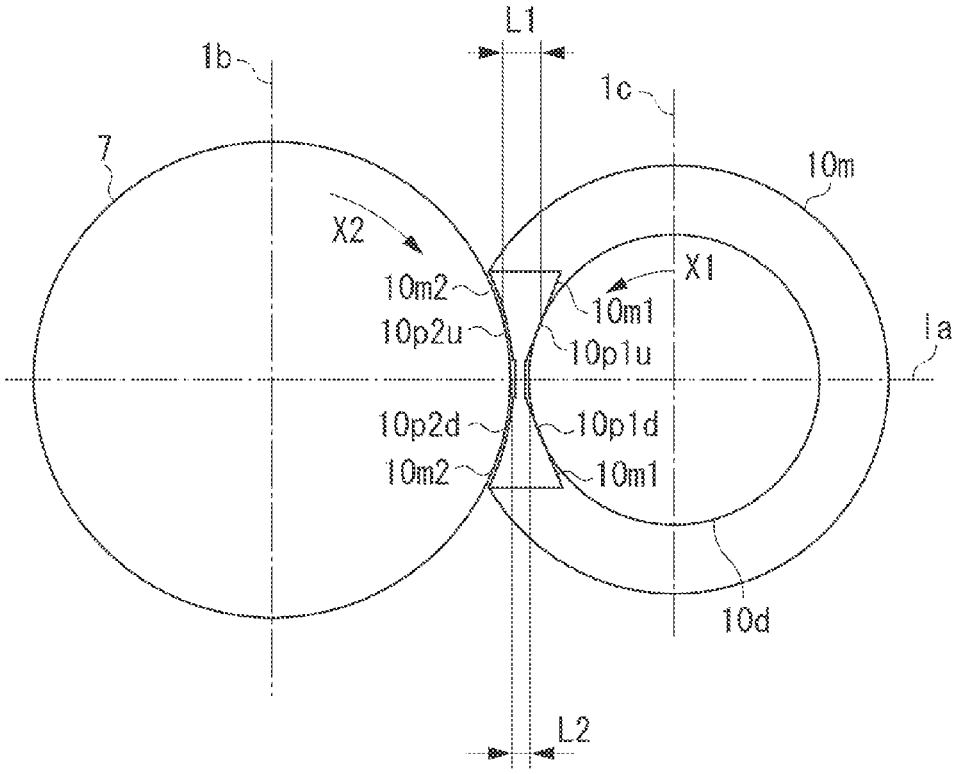
FIG. 4 is a cross-sectional view illustrating a configuration of the space ensuring member according to an exemplary embodiment.

As illustrated in FIGS. 1 and 4, the spacer 10*m* includes developing roller contact surfaces 10*m*1 and photosensitive drum contact surfaces 10*m*2. The developing roller contact surface 10*m*1 extends along the developing roller 10*d*. The photosensitive drum contact surface 10*m*2 extends along the photosensitive drum 7.

The contact surfaces 10*m*1 and 10*m*2, which are flat surfaces in the present exemplary embodiment as illustrated in FIG. 4, are not limited to the flat surfaces, and may be curved surfaces.

The arrangement of the developing roller contact surface 10*m*1 of the spacer 10*m* in the longitudinal direction is as follows with reference to FIGS. 1, 6, and 7. Specifically, in the longitudinal direction of the developing roller 10*d*, the contact surface 10*m*1 is disposed in an area on the developing roller large diameter portion 10*d*1 facing the seal member 10*g*.

Developing roller contact portions 10*p*1 (10*p*1*u* and 10*p*1*d*) and photosensitive drum contact portions 10*p*2 (10*p*2*u* and 10*p*2*d*) are each disposed on opposite sides with respect to a line (straight line) la. The line 1*a* connects between the rotational center of the photosensitive drum 7 and the rotational center of the developing roller 10*d*.

When the circumferential alignment of the photosensitive drum 7 and the developing roller 10*d* is not aligned in the longitudinal direction, the line 1*a* is defined as follows. Specifically, the line 1*a* is a line connecting between the rotational center of the photosensitive drum 7 and an arbitrary center of the developing roller 10*d* in a cross section at an arbitrary position in the longitudinal direction, within a range, in the longitudinal direction of the developing roller 10*d*, where the spacer 10*m* is in contact with the photosensitive drum 7 and the developing roller 10*d*.

The photosensitive drum contact portion 10*p*2 is disposed on a side closer to the developing roller 10*d* than a line 1*b* that passes through the rotational center of the photosensitive drum 7 and is orthogonal to the line 1*a*.

The developing roller contact portion 10*p*1 is disposed on a side closer to the photosensitive drum 7 than a line 1*c* that passes through the rotational center of the developing roller 10*d* and is orthogonal to the line 1*a*.

A distance L1 is provided between the photosensitive drum contact portion 10*p*2*u* and the developing roller contact portion 10*p*1*u* that are on the upstream side in the rotation direction of the photosensitive drum. The photosensitive drum contact portion 10*p*2*u* and the developing roller contact portion 10*p*1*u* are disposed more on the upstream side of the line 1*a* in a rotational direction of the photosensitive drum 7. The distance L1 is also provided between the photosensitive drum contact portion 10*p*2*d* and the developing roller contact portion 10*p*1*d* that are on the downstream side. The photosensitive drum contact portion 10*p*2*d* and the developing roller contact portion 10*p*1*d* are disposed more on the downstream side than the line 1*a* in the rotational direction of the photosensitive drum 7. Here, the distance L1 is measured in a direction parallel with the line 1*a*. The distance L1 is set to be longer than a distance L2 between closest portions of the photosensitive drum 7 and the developing roller 10*d*.

Next, an operation of ensuring a space between the photosensitive drum 7 and the developing roller 10*d* will be described.

As described above, the photosensitive drum 7 and the developing roller 10*d* are relatively movable with each other. The predetermined pressing force f is applied between the developing unit 10 and the drum unit 11 so that the photosensitive drum 7 and the developing roller 10*d* are urged toward each other.

The pressing force f brings the developing roller contact portions 10*p*1 (10*p*1*u* and 10*p*1*d*) in the developing roller contact surfaces 10*m*1 of the spacer 10*m* into contact with the large diameter portion 10*d*1 of the developing roller 10*d*, as illustrated in FIG. 4. Here, the photosensitive drum contact portions 10*p*2 (10*p*2*u* and 10*p*2*d*) of the photosensitive drum contact surfaces 10*m*2 are brought into contact with the surface of the photosensitive drum 7. Thus, a predetermined space is maintained between the developing roller 10*d* and the photosensitive drum 7.

Specifically, the spacer 10*m* includes a maintaining portion 10*m*10 (see FIGS. 5 and 6) that is disposed between the developing roller 10*d* and the photosensitive drum 7 and maintains the distance therebetween. The maintaining portion 10*m*10 includes the photosensitive drum contact portions 10*p*2*u* and 10*p*2*d* and the developing roller contact portions 10*p*1*u* and 10*p*1*d*.

The photosensitive drum contact portion 10*p*2*u* is a first image bearing member side sliding portion. The first image bearing member side sliding portion comes into contact with (slides on) the photosensitive drum 7 at a portion disposed more on the upstream side than the line 1*a* in the rotational direction of the photosensitive drum 7. The photosensitive drum contact portion 10*p*2*d* is a second image bearing member side sliding portion that comes into contact with (slides) the photosensitive drum 7 at a portion disposed more on the downstream side than the line 1*a* in the rotational direction of the photosensitive drum 7. Similarly, the developing roller contact portion 10*p*1*u* is a first developing side sliding portion. The first developing side sliding portion comes into contact with (slides on) the developing roller 10*d* at a portion disposed more on the upstream side than the line 1*a* in the rotational direction of the developing roller 10*d*. The developing roller contact portion 10*p*1*d* is a second developing side sliding portion that comes into contact with (slides on) the developing roller 10*d* at a portion disposed more on the downstream side than the line 1*a* in the rotational direction of the developing roller 10*d*.

An operation for preventing the spacer 10*m* from rotating will be described.

In the present exemplary embodiment, the photosensitive drum 7 rotates in an X2 direction, and the developing roller 10*d* rotates in an X1 direction. Thus, the photosensitive drum 7 and the developing roller 10*d* rotate with their facing surfaces moving in the same direction. Therefore, the friction force produced between the spacer 10*m* and the developing roller 10*d* and the photosensitive drum 7 forces the spacer 10*m* to move in the X1 and the X2 directions. Thus, the spacer 10*m* is provided with a rotation regulation portion (photosensitive drum contact portion 10*p*2*u*). Thus, the rotational movement of the spacer 10*m* in the X1 direction about the developing roller 10*d* is prevented.

The spacer 10*m* is disposed with the distance L1 being set to be longer than the distance L2. The distance L1 is provided between the photosensitive drum contact portion 10*p*2*u* and the developing roller contact portion 10*p*1*u* that are disposed more on the upstream side than the line 1*a* in the rotational direction of the developing roller 10*d*. The distance L2 is provided between the closest portions of the photosensitive drum 7 and the developing roller 10*d*. The distance L1 is measured in a direction parallel with the line 1*a*. The distance L2 is a shortest distance between the surface of the photosensitive drum 7 and the surface of the developing roller 10*d* and is a distance of the space between the surface of the photosensitive drum 7 and the surface of the developing roller 10*d* on the line 1*a*.

When an image is formed, the pressing force f is applied to the developing roller 10*d* and the photosensitive drum 7. Thus, the photosensitive drum contact portion 10*p*2*u* in contact with the photosensitive drum 7 is unmovable in the X1 and the X2 directions even when the developing roller 10*d* and the photosensitive drum 7 rotate. Thus, the spacer 10*m* does not rotate. All things considered, the spacer 10*m* is prevented from moving in the rotational directions X1 and X2 of the developing roller 10*d* and the photosensitive drum 7.

As described above, the movement of the spacer 10*m* in the rotational direction is regulated through the contact between the spacer 10*m* and the photosensitive drum 7. Therefore, no structure other than the photosensitive drum 7 is required for position regulation of the spacer 10*m* in the rotational direction X1 or X2.

A configuration and an operation for positioning the spacer 10*m* in the longitudinal direction will be described.

As illustrated in FIGS. 1, 5, 6, and 7, the spacer 10*m* includes a longitudinal direction positioning portion 10*m*3 in an outer direction in the longitudinal direction of the developing roller 10*d*. The longitudinal direction positioning portion 10*m*3 includes a hole 10*m*4 through which the small diameter portion 10*d*2 of the developing roller 10*d* penetrates.

As illustrated in FIG. 6, the through hole 10*m*4 is not in contact with the small diameter portion 10*d*2 of the developing roller 10*d* that penetrates the through hole 10*m*4, in a state where the spacer 10*m* is positioned by the photosensitive drum 7 and the developing roller 10*d*. The inner diameter of the through hole 10*m*4 is larger than the diameter of the small diameter portion 10*d*2 of the developing roller 10*d*.

Thus, the through hole 10*m*4 and the small diameter portion 10*d*2 of the developing roller 10*d* do not interfere with each other in the state where the space between the photosensitive drum 7 and the developing roller 10*d* is maintained by the spacer 10*m*. Accordingly, the space between the photosensitive drum 7 and the developing roller 10*d* can be appropriately maintained.

As illustrated in FIG. 7, the longitudinal direction positioning portion 10*m*3 is disposed between the arm portion 10*q*1 and a step surface between the large and the small diameter portions 10*d*1 and 10*d*2 of the developing roller 10*d*. Thus, the positioning in the longitudinal direction is achieved.

Next, a configuration for arranging the spacer 10*m* in the longitudinal direction will be described with reference to FIGS. 5, 6, and 7.

Figure 5:
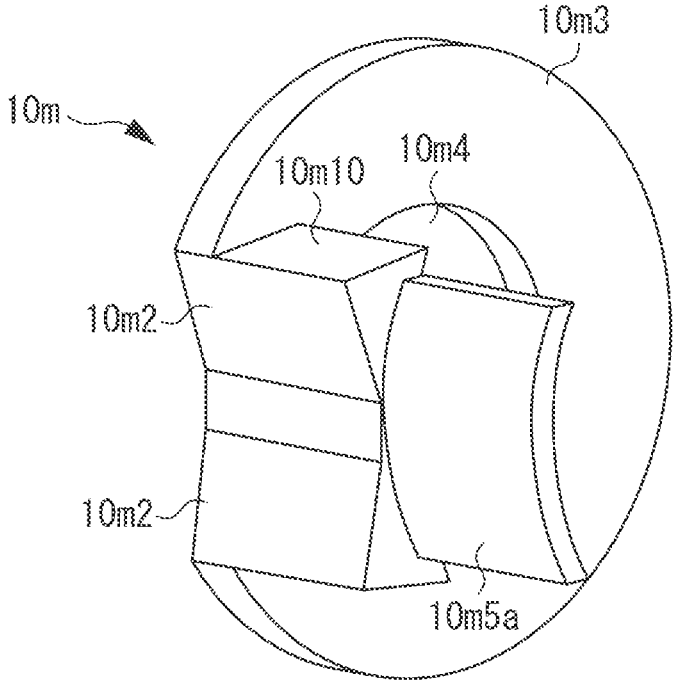
FIG. 5 is a perspective view illustrating the configuration of the space ensuring member according to an exemplary embodiment.

The spacer 10*m* of the present exemplary embodiment has the maintaining portion 10*m*10 only between the photosensitive drum 7 and the developing roller 10*d* as illustrated in FIG. 5. Thus, a space is formed on a side of the developing roller 10*d* opposite to the maintaining portion 10*m*10. Therefore, the seal member 10*g* can be disposed on the opposite side of the maintaining portion 10*m*10 as illustrated in FIG. 6.

The spacer 10*m* does not rotate even when the developing roller 10*d* rotates. Thus, the seal member 10*g* and the spacer 10*m* (maintaining portion 10*m*10 thereof) do not interfere with each other in the circumferential direction.

The spacer 10*m* is arranged in the longitudinal direction as illustrated in FIGS. 1 and 7. Specifically, in the longitudinal direction of the developing roller 10*d*, the photosensitive drum contact portion 10*p*1 forming the maintain portion 10*m*10 of the spacer 10*m* overlaps with a seal function surface of the seal member 10*g* in a center axis direction of the developing roller 10*d*. The seal function surface is a surface (function portion) that provides a toner sealing property.

As illustrated in FIGS. 1 and 7, the seal member 10*g* and the spacer 10*m* can be disposed in the overlapping manner. Thus, the space in which the spacer 10*m* and the seal member 10*g* are disposed can be made small, whereby downsizing of the developing unit 10 and the process cartridge B can be achieved.

(Configuration and Operation of Fogging Preventing Cover Portion)

A configuration of a cover portion 10*m*5 as a key element of the present invention will be described with reference to FIGS. 5, 6, 7, 8A, and 8B.

As illustrated in FIG. 5, the cover portion 10*m*5 is integrally formed with other portions of the spacer 10*m*. Such a spacer 10*m* can be manufactured by injection molding.

As illustrated in FIG. 7, the cover portion 10*m*5 has such a shape, in the longitudinal direction, as to cover (be provided over) an area C2 including an entire area of the gap Z between the developing blade 10*e* and the seal member 10*g* including an end surface of the developing blade 10*e*. Thus, the area C2 covered by the cover portion 10*m*5 includes an entire region between the developing blade 10*e* and the seal member 10*g* in the longitudinal direction.

The cover portion 10*m*5 covers an entire developing area D of the developing roller 10*d* in the circumferential direction (the rotational direction X1 of the developing roller 10*d*: see FIG. 4) of the developing roller 10*d*. Specifically, as illustrated in FIG. 6, the cover portion 10*m*5 covers (is provided over) a cover area C1 larger than the developing area D in a cross section of the cover portion 10*m*5 taken along a direction orthogonal to the longitudinal direction of the developing roller 10*d*.

The developing area D is an area of the developing roller 10*d* facing the photosensitive drum 7 in FIG. 6 (surface orthogonal to the longitudinal direction). Specifically, in the developing area D, the toner carried by the developing roller 10*d* is movable from the developing roller 10*d* to the photosensitive drum 7 when the image is formed. More specifically, in the developing area D, the electric field formed between the developing roller 10*d* and the photosensitive drum 7 causes the toner to jump from the developing roller 10*d* to the photosensitive drum 7.

As illustrated in FIG. 6, the cover portion 10*m*5 is set to have a thickness 10*m*5*t* smaller than the distance L2 between the closest portions of the photosensitive drum 7 and the developing roller 10*d*.

As illustrated in FIG. 6, the cover portion 10*m*5 is disposed at a position to be in contact with neither the surface of the photosensitive drum 7 nor the surface of the developing roller 10*d* in the cross section taken along the direction orthogonal to the longitudinal direction of the developing roller 10*d*.

Next, a material of the cover portion 10*m*5 will be described. The material used for the cover portion 10*m*5 is the same as the material of the spacer 10*m* in the present exemplary embodiment. The material of the cover portion 10*m*5 is not limited to the material that is the same as that of the spacer 10*m*, and a different material may also be appropriately selected.

This is because, unlike the spacer 10*m* that slides on the photosensitive drum 7 and the developing roller 10*d*, the cover portion 10*m*5 is not a member that ensures a space between the photosensitive drum 7 and the developing roller 10*d*. Specifically, the space between the photosensitive drum 7 and the developing roller 10*d* cannot be maintained when the spacer 10*m* is worn from being in contact with the photosensitive drum 7 and the developing roller 10*d*. Thus, the spacer 10*m* is preferably formed of a wear-resistant material. On the other hand, the cover member 10*m*5 needs not to be made of the wear-resistant material, and thus may be made of a material different from that of the spacer 10*m*.

Two-color molding may be employed for the injection molding of different materials in an integrated manner. Thus, with the two-color molding, the cover member 10*m*5, formed of a material different from that of the spacer 10*m*, can be integrally formed with a main body of the spacer 10*m*. The main body of the spacer 10*m* is a configuration of the spacer 10*m* without the cover member 10*m*5. The main body of the spacer 10*m* includes the photosensitive drum contact portion 10*p*2*u*, the photosensitive drum contact portion 10*p*2*d*, the developing roller contact portion 10*p*1*u*, and the developing roller contact portion 10*p*1*d* (the maintaining portion and the rotation regulating portion).

(Other Configuration of Cover Portion)

The following two configurations are described. These configurations are employed when the distance L2 between the closest portions of the photosensitive drum 7 and the developing roller 10*d* needs to be set to be small so that the thickness 10*m*5*t* of the cover portion 10*m*5 becomes so small that makes the mass production with injection molding difficult.

In a first configuration, the cover portion 10*m*5 comes into contact with the photosensitive drum 7 so that the thickness 10*m*5*t* of the cover portion 10*m*5 is set to be large enough to enable the mass production. A configuration in which the cover portion 10*m*5 comes into contact with the surface of the developing roller 10*d* cannot be employed. This is because the configuration leads to the scattering of the toner carried by the surface of the developing roller 10*d*.

Figure 8A:
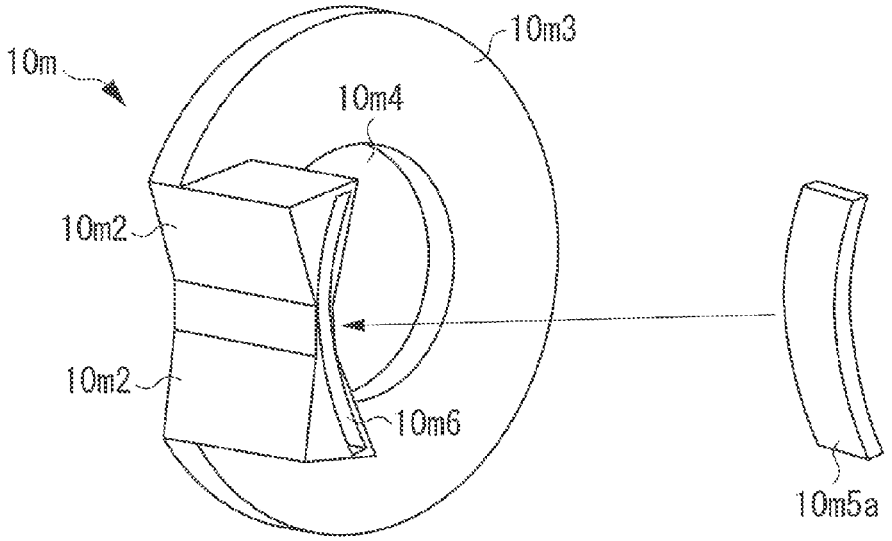
FIGS. 8A and 8B are perspective views each illustrating a configuration of a space ensuring member according to an exemplary embodiment.
Figure 8B:
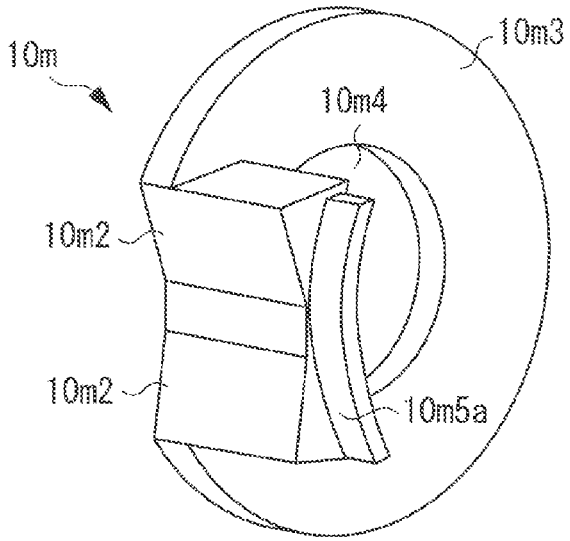

In a second configuration, the cover portion 10*m*5 is formed as a separate portion (formed as a separate member) with respect to the main body of the spacer 10*m*, as illustrated in FIGS. 8A and 8B. The cover portion 10*m*5 formed as the separate portion with respect to the main body of the spacer 10*m* will be specifically referred to as a cover member 10*m*5*a*. A configuration for attaching the cover member 10*m*5*a* as the separate portion to the spacer 10*m* will be described below.

The cover member 10*m*5*a* as the separate portion can be made by extrusion molding. The cover member 10*m*5*a* can be mass produced with a shape much thinner than the cover portion 10*m*5 integrally formed with the spacer 10*m* by injection molding As illustrated in FIG. 8A, the spacer 10*m* has a groove portion 10*m*6. The groove 10*m*6 has a shape that is substantially the same as the cross-sectional shape of the cover member 10*m*5*a* taken along the direction orthogonal to the longitudinal direction of the developing roller 10*d*. The cover member 10*m*5*a* and the groove portion 10*m*6 have such a dimensional relationship that the cover member 10*m*5*a* is press fit in the groove 10*m*6.

In this configuration, the cover member 10*m*5*a* can be attached to the main body of the spacer 10*m* by being press fit in the groove portion 10*m*6 as illustrated in FIG. 8B.

In this manner, the cover member 10*m*5*a* can be accurately positioned between the photosensitive drum 7 and the developing roller 10*d* by being attached to the spacer 10*m* (main body thereof) positioned by the photosensitive drum 7 and the developing roller 10*d*.

In the present exemplary embodiment, the attaching method of press fitting the cover member 10*m*5*a* into the groove 10*m*6 formed in the spacer 10*m* is described. However, the attaching method is not limited to this press fitting method, and a method such as bonding may be employed, for example.

Next, a material of the cover member 10*m*5*a* as the separate portion will be described.

The cover member 10*m*5*a* can be made of any material that can be used for extrusion molding to be mass produced with a smaller thickness compared with the case of the injection molding as described above. For example, the material may be selectable to be the same as or different from the space ensuring member for example.

Specifically, the material of an object made by the extrusion molding includes polyethylene terephthalate, polystyrene, and polypropylene.

(Configuration, Operation, and Effect of Cover Portion)

An operation and an effect of the cover portion 10*m*5 will be described.

As illustrated in FIG. 7, the amount of toner carried by the developing roller 10*d* is not regulated at a portion on the outer side than an end portion of the developing blade 10*e*, in the longitudinal direction. The toner not pressed by the developing blade 10*e* is carried by the surface of the developing roller 10*d*, in an area of the gap Z between the developing blade 10*e* and the seal member 10*g* (an area that is on an outer side than the end portion of the developing blade 10*e* and on an inner side than the seal member 10*g*, in the longitudinal direction).

The toner not pressed by the developing blade 10*e* is not appropriately charged by friction. Thus, the toner that is not supposed to be developed on a drum might be developed on the surface of the photosensitive drum 7.

In the present exemplary embodiment, in the cover area C1, the cover portion 10*m*5 blocks the developing area D in the cross section of the cover portion 10*m*5 taken along the direction orthogonal to the longitudinal direction, as illustrated in FIG. 6. As further illustrated in FIG. 7, the cover portion 10*m*5 covers the area C2 including the gap Z between the developing blade 10*e* and the seal member 10*g* in the longitudinal direction. Thus, the toner that is not appropriately charged as described above can be prevented from being accidentally transferred onto the photosensitive drum 7.

Thus, the accidental movement of the toner to the photosensitive drum 7 can be prevented by the cover portion 10*m*5. As a result, the toner does not attach to the end portion of the recording medium 2, whereby the recording medium 2 can be kept clean.

As an effect of the forming the cover portion 10*m*5 with the different material, a cheaper material such as polystyrene can be selected for the cover portion 10*m*5. Thus, the component cost can be reduced.

The following effect can be obtained by forming the cover portion 10*m*5 as the cover member 10*m*5*a* that is the separate portion with respect to the spacer 10*m*. Specifically, the cover member 10*m*5*a* can be attached to the spacer 10*m* even when the smaller distance L2 is set between the closest portions of the photosensitive drum 7 and the developing roller 10*d*. Thus, the cover portion 10*m*5 as the cover member 10*m*5*a*, which is the separate portion with respect to the spacer 10*m*, can be made thin. As a result, the distance L2 between the closest portions of the photosensitive drum 7 and the developing roller 10*d* can be set to be small, and thus can be more freely set.

The cover portion 10*m*5 as the separate portion can be more freely manufactured. For example, under the current technical level, to obtain the cover portion 10*m*5 having a thickness in the range between 100 to 200 μm through injection molding, a manufacturer faces a high technical difficulty requiring a high manufacturing cost. On the other hand, it is a common practice to manufacture a sheet with a thickness in such a range through the extrusion molding. Therefore, the cover member 10*m*5 as a sheet obtained by the extrusion molding can be manufactured at a low cost, whereby the component cost is reduced.

As a further effect of forming the cover portion 10*m*5 as the cover member 10*m*5*a*, which is the separate member with respect to the spacer 10*m*, the component can be reused. Specifically, the space assuring portion wears and thus cannot be reused after severe wearing. The cover member 10*m*5*a* does not wear and thus can be used for multiple times.

When the cover member 10*m*5*a* can be shared among multiple models, a further effect that the cover member 10*m*5*a* can be reused among multiple models can be achieved.

In the present exemplary embodiment, the cover portion 10*m*5*a* covers the entire gap Z (see FIG. 7) between the developing blade 10*e* and the seal member 10*g* in the longitudinal direction. Alternatively, the gap Z may be at least partially covered. In this configuration, the toner can be partially prevented from moving from the developing roller 10*d* to the photosensitive drum 7, whereby a certain level of effectiveness is obtained.

In the present exemplary embodiment, the cover portion 10*m*5 covers the entire developing area D (see FIG. 6) in the circumferential direction (rotational direction) of the developing roller 10*d*. Alternatively, the cover portion 10*m*5 may at least partially cover the developing roller 10*d* in the developing area D. In this configuration, the amount of toner moving from the developing roller 10*d* to the photosensitive drum 7 in the developing area D can be reduced.

It is matter of course that, if possible, a configuration where the cover portion 10*m*5 covers the developing roller 10*d* in a range entirely including the area of the gap Z of the cover portion 10*m*5 (see FIG. 7) and the developing area D (see FIG. 6) is most favorable for reducing the amount of toner moving from the developing roller 10*d* to the photosensitive drum 7. Thus, the range covered by the cover portion 10*m*5 may be appropriately set in accordance with the level of the fogging in an end portion.

The process cartridge B is not limited to the configuration of forming a monotone image as exemplarily described in the present exemplary embodiment. For example, the process cartridge B may include a plurality of developing units to form a multiple color image (for example, a two color image, a three color image, or a full color image).

In the present exemplary embodiment, the case where the spacer 10*m* is used in the process cartridge B is described. The developing unit (developing device) 10 including the spacer 10*m* serves as a part of the process cartridge B.

Alternatively, the developing unit (developing device) 10 can be attached to and detached from the image forming apparatus A separately from the photosensitive drum 7 (the developing unit 10 can be independently attached and detached as the developing cartridge). Furthermore, the developing unit (developing device) 10 may be built in the image forming apparatus A, so as not to be removed from the image forming apparatus A by a user.

Figure 9:
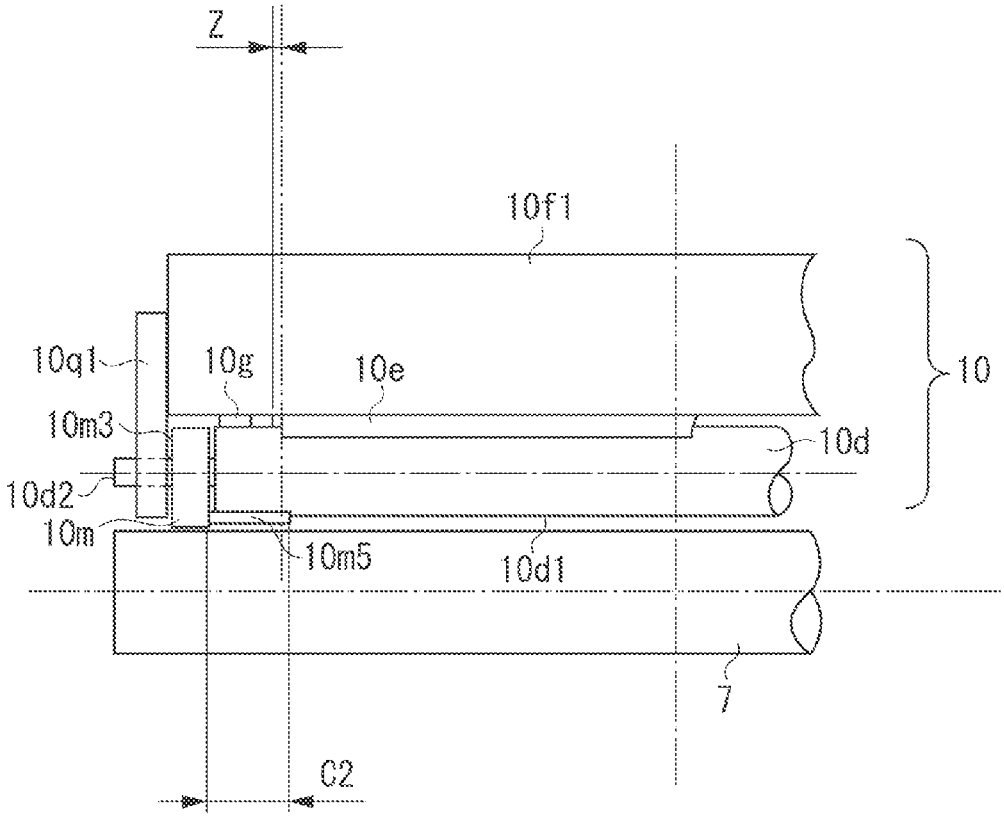
FIG. 9 is an explanatory diagram illustrating the configuration according to an exemplary embodiment in the longitudinal direction.

Next, a second exemplary embodiment will be described with reference to FIGS. 9 and 10. The configurations and operations that are the same as those in the first exemplary embodiment will not be described.

In the first exemplary embodiment, the contact portion of the developing roller 10*d* that comes into contact with the spacer 10*m* (space ensuring member) is the surface of the large diameter portion 10*d*1 of the developing roller 10*d*. In this exemplary embodiment, the small diameter portion 10*d*2 of the developing roller 10*d* is set as the contact portion of the developing roller 10*d*, as illustrated in FIGS. 9 and 10.

Figure 10:
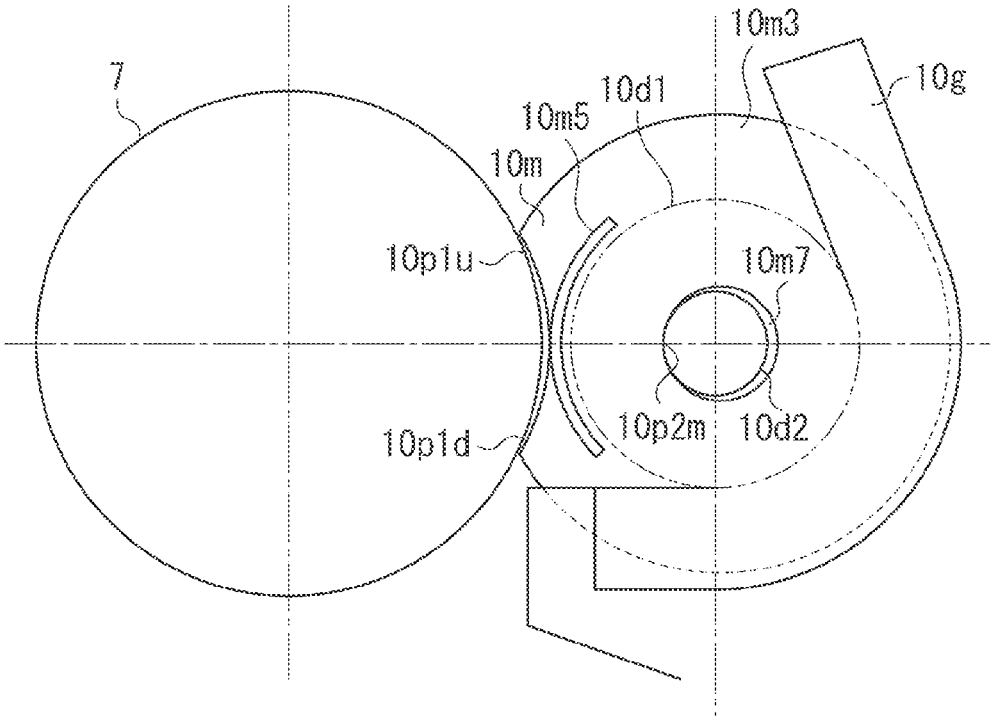
FIG. 10 is a cross-sectional view illustrating the configuration of the space ensuring member according to an exemplary embodiment.

Here, the spacer 10*m* is provided with a hole 10*m*7 larger than the small diameter portion 10*d*2 of the developing roller 10*d* as illustrated in FIG. 10. Thus, in a state where the positioning in the cross-sectional direction is achieved by the contact surfaces 10*p*1*u* and 10*p*1*d* on the side of the photosensitive drum 7 and the contact surface 10*p*2*m* on the side of the developing roller 10*d*, the small diameter portion 10*d*2 of the developing roller 10*d* and the hole 10*m*7 of the spacer 10*m* do not interfere with each other. Thus, the space between the photosensitive drum 7 and the developing roller 10*d* can be appropriately set.

Thus, in the present exemplary embodiment, the maintaining portion that maintains the space between the developing roller 10*d* and the photosensitive drum 7 has the following configuration. Specifically, the maintaining portion includes a contact surface 10*p*2*m* (developing side sliding portion that slides on the small diameter portion 10*d*2 of the developing roller 10*d*) formed in the hole 10*m*7, the contact surface 10*p*1*u* (first image bearing member side sliding portion) for the photosensitive drum 7, and the contact surface 10*p*1*d* (second image bearing member side sliding portion).

Thus, the maintaining portion of the spacer 10*m* that maintains the space between the photosensitive drum 7 and the developing roller 10*d* includes the contact surfaces 10*p*1*u*, 10*p*1*d*, and 10*p*2*m*. The contact surface 10*p*1*u* serves as the rotation regulation member that prevents the spacer 10*m* from moving in the rotational directions (X1 and X2) of the photosensitive drum 7 and the developing roller 10*d*. The contact surface 10*p*1*u* is positioned more on the upstream side than the line 1*a* connecting between the rotational centers of the developing roller 10*d* and the photosensitive drum 7, in the rotational direction X2 of the photosensitive drum 7. The contact surface 10*p*1*u* comes into contact with the photosensitive drum 7, and thus the spacer 10*m* is prevented from moving in the rotational directions X1 and X2 of the developing roller 10*d* and the photosensitive drum 7.

The present exemplary embodiment can be suitably applied to the cartridge that forms the multiple color image, as is the case of the first exemplary embodiment, and can be applied to the process cartridge and to the developing device.

According to the present invention, the fogging can be prevented from occurring outside the developer regulating member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-240143 filed Nov. 20, 2013, which is hereby incorporated by reference herein in its entirety.

What is claimed is:

1. A developing device comprising:

a developer bearing member configured to carry a developer for developing a latent image formed on an image bearing member;

a developer regulating member configured to regulate an amount of the developer carried by the developer bearing member; and a space ensuring member configured to define a space between the image bearing member and the developer bearing member, wherein the space ensuring member includes a maintaining unit configured to maintain the space between the image bearing member and the developer bearing member by being in contact with the image bearing member, a rotation regulating portion configured to prevent the space ensuring member from moving in a rotational direction of the developer bearing member, and a cover portion disposed to be not in contact with a surface of the developer bearing member and configured to cover a part of the developer bearing member, and wherein the cover portion is configured to cover at least part of an area in which the developer bearing member faces the image bearing member in the rotational direction of the developer bearing member, the area being on an outer side of an end portion of the developer regulating member in a longitudinal direction of the developer bearing member.

2. The developing device according to claim 1, further comprising:

a frame member configured to contain the developer; and a seal member configured to prevent the developer from leaking between an end portion of the developer bearing member and the frame member, wherein the area covered by the cover portion includes an entire range between the developer regulating member and the seal member in the longitudinal direction.

3. The developing device according to claim 1, wherein the rotation regulating portion comes into contact with the image bearing member at a portion more on an upstream side than a straight line connecting between respective rotational centers of the image bearing member and the developer bearing member, in a rotational direction of the image bearing member.

4. The developing device according to claim 1, wherein the area covered by the cover portion includes an entire area in which the developer moves from the developer bearing member to the image bearing member, in the rotational direction of the developer bearing member.

5. The developing device according to claim 1, wherein the cover portion is integrally formed with a main body of the space ensuring member including the maintaining unit.

6. The developing device according to claim 1, wherein the cover portion is formed as a separate portion with respect to a main body of the space ensuring member including the maintaining unit, and is attached to the main body.

7. The developing device according to claim 1, wherein the cover portion is formed of a material different from a material of a main body of the space ensuring member including the maintaining unit.

8. The developing device according to claim 1, wherein the developer bearing member rotates in such a manner that respective facing surfaces of the developer bearing member and the image bearing member move in a same direction.

9. The developing device according to claim 1, wherein the maintaining unit includes a first image bearing member side sliding portion configured to slide on the image bearing member at a portion more on an upstream side than a straight line connecting between respective rotational centers of the image bearing member and the developer bearing member, in a rotational direction of the image bearing member, a second image bearing member side sliding portion configured to slide on the image bearing member at a portion more on a downstream side than the straight line, in the rotational direction of the image bearing member, a first developing side sliding portion configured to slide on the developer bearing member at a portion more on the upstream side than the straight line, in the rotational direction of the developer bearing member, and a second developing side sliding portion configured to slide on the developer bearing member at a portion more on the downstream side than the straight line, in the rotational direction of the developer bearing member.

10. The developing device according to claim 1, wherein the developer bearing member includes a large diameter portion configured to carry the developer and a small diameter portion that has a smaller diameter than the large diameter portion and is rotatably supported by a frame member of the developing device, wherein the maintaining unit includes a first image bearing member side sliding portion configured to slide on the image bearing member at a portion more on an upstream side than a straight line connecting between respective rotational centers of the image bearing member and the developer bearing member, in a rotational direction of the image bearing member, a second image bearing member side sliding portion configured to slide on the image bearing member at a portion more on a downstream side than the straight line in the rotational direction of the image bearing member, and a developing side sliding portion configured to slide on the small diameter portion.

11. A process cartridge detachably attached to an apparatus main body of an image forming apparatus configured to form an image on a recording medium, the process cartridge comprising:

an image bearing member on which a latent image is formed;

a developer bearing member configured to carry a developer for developing the latent image;

a developer regulating member configured to regulate an amount of the developer carried by the developer bearing member; and a space ensuring member configured to define a space between the image bearing member and the developer bearing member, wherein the space ensuring member includes a maintaining unit configured to maintain the space between the image bearing member and the developer bearing member by being in contact with the image bearing member, a rotation regulating portion configured to prevent the space ensuring member from moving in a rotational direction of the developer bearing member, and a cover portion disposed to be not in contact with a surface of the developer bearing member and configured to cover a part of the developer bearing member, and wherein the cover portion is configured to cover at least part of an area in which the developer bearing member faces the image bearing member in the rotational direction of the developer bearing member, the area being on an outer side of an end portion of the developer regulating member in a longitudinal direction of the developer bearing member.

12. The process cartridge according to claim 11, wherein the developer bearing member is urged toward the image bearing member.

13. The process cartridge according to claim 11, further comprising:

a frame member configured to contain the developer; and a seal member configured to prevent the developer from leaking between an end portion of the developer bearing member and the frame member, wherein the area covered by the cover portion includes an entire range between the developer regulating member and the seal member in the longitudinal direction.

14. The process cartridge according to claim 11, wherein the rotation regulating portion comes into contact with the image bearing member at a portion more on an upstream side than a straight line connecting between respective rotational centers of the image bearing member and the developer bearing member, in a rotational direction of the image bearing member.

15. The process cartridge according to claim 11, wherein the area covered by the cover portion includes an entire area in which the developer moves from the developer bearing member to the image bearing member, in the rotational direction of the developer bearing member.

16. The process cartridge according to claim 11, wherein the cover portion is integrally formed with a main body of the space ensuring member including the maintaining unit.

17. The process cartridge according to claim 11, wherein the cover portion is formed as a separate portion with respect to a main body of the space ensuring member including the maintaining unit, and is attached to the main body.

18. The process cartridge according to claim 11, wherein the cover portion is formed of a material different from a material of a main body of the space ensuring member including the maintaining unit.

19. The process cartridge according to claim 11, wherein the developer bearing member rotates in such a manner that respective facing surfaces of the developer bearing member and the image bearing member move in a same direction.

20. An image forming apparatus configured to form an image on a recording medium, the image forming apparatus comprising:

an image bearing member on which a latent image is formed;

a developing device; and a conveyance mechanism configured to convey the recording medium, wherein the developing device includes a developer bearing member configured to carry a developer for developing the latent image;

a developer regulating member configured to regulate an amount of the developer carried by the developer bearing member; and a space ensuring member configured to define a space between the image bearing member and the developer bearing member, wherein the space ensuring member includes a maintaining unit configured to maintain the space between the image bearing member and the developer bearing member by being in contact with the image bearing member, a rotation regulating portion configured to prevent the space ensuring member from moving in a rotational direction of the developer bearing member, and a cover portion disposed to be not in contact with a surface of the developer bearing member and configured to cover a part of the developer bearing member, and wherein the cover portion is configured to cover at least part of an area in which the developer bearing member faces the image bearing member in a rotational direction of the developer bearing member, the area being on an outer side of an end portion of the developer regulating member in a longitudinal direction of the developer bearing member.

* * * * *